US009976527B1

(12) United States Patent
Campion et al.

(10) Patent No.: US 9,976,527 B1
(45) Date of Patent: May 22, 2018

(54) FUEL INJECTOR ASSEMBLY HAVING SLEEVE FOR DIRECTING FUEL FLOW

(71) Applicant: Caterpillar Inc., Peoria, IL (US)

(72) Inventors: Robert Campion, Chillicothe, IL (US); George Kodikulam Joseph, Pontiac, IL (US); Satya Naga Deepak Pillarisetti, Pontiac, IL (US); Zhenyu Li, Peoria, IL (US)

(73) Assignee: Caterpillar Inc., Deerfield, IL (US)

( * ) Notice: Subject to any disclaimer, the term of this patent is extended or adjusted under 35 U.S.C. 154(b) by 0 days. days.

(21) Appl. No.: 15/405,925

(22) Filed: Jan. 13, 2017

(51) Int. Cl.

| | |
|---|---|
| ***F02M 53/04*** | (2006.01) |
| ***F02M 61/14*** | (2006.01) |
| ***F02M 55/00*** | (2006.01) |
| ***F02M 55/02*** | (2006.01) |

(52) U.S. Cl.
CPC ..... *F02M 53/043* (2013.01); *F02M 55/004* (2013.01); *F02M 55/008* (2013.01); *F02M 55/025* (2013.01); *F02M 61/14* (2013.01)

(58) Field of Classification Search
CPC ..... F02M 53/04; F02M 53/043; F02M 55/00; F02M 55/004; F02M 55/008; F02M 55/025; F02M 61/14; F02M 61/145; F02M 61/16; F02M 61/162; F02M 61/163; F02M 61/165; F02M 61/167; F02M 61/168
USPC ..... 123/41.31, 445, 468–470, 472, 473, 123/476–478, 490; 701/103
See application file for complete search history.

(56) References Cited

U.S. PATENT DOCUMENTS

| | | | | |
|---|---|---|---|---|
| 2,175,450 | A | 10/1939 | Thege | |
| 2,886,014 | A | 5/1959 | Konrad et al. | |
| 4,351,480 | A | 9/1982 | Masaki et al. | |
| 6,119,658 | A * | 9/2000 | Jehle | F02M 61/14 123/41.31 |
| 6,196,195 | B1 * | 3/2001 | Trutschel | F02M 53/04 123/41.31 |
| 6,481,641 | B1 | 11/2002 | Mieney | |
| 7,819,107 | B2 | 10/2010 | Stockner et al. | |
| 7,849,836 | B2 | 12/2010 | Chang | |
| 8,201,754 | B2 | 6/2012 | Chang | |
| 8,230,838 | B2 * | 7/2012 | Clark | F02F 1/242 123/470 |
| 8,434,457 | B2 | 5/2013 | Coldren et al. | |
| 8,480,009 | B2 | 7/2013 | Hanson et al. | |
| 8,517,284 | B2 | 8/2013 | Ibrahim et al. | |
| 9,341,153 | B2 | 5/2016 | Ibrahim et al. | |
| 9,382,887 | B2 | 7/2016 | Clark et al. | |
| 2010/0043756 | A1 * | 2/2010 | Hanneke | F02M 61/14 123/470 |

(Continued)

FOREIGN PATENT DOCUMENTS

| | | |
|---|---|---|
| GB | 358779 | 10/1931 |

*Primary Examiner* — John Kwon
*Assistant Examiner* — Johnny H Hoang
(74) *Attorney, Agent, or Firm* — Mattingly, Burke, Cohen & Biederman

(57) ABSTRACT

A fuel injector assembly for an engine system includes a fuel pressurization mechanism, a fuel injector, and a flow-directing sleeve positioned about the fuel injector and including sealing surfaces for sealing with a cylinder head and with an injector body. Slots are formed at least in part in the sealing surfaces to direct fuel from the cylinder head into an incoming cooling passage extending to the fuel pressurization mechanism, and from an outgoing cooling fuel passage into the cylinder head.

20 Claims, 4 Drawing Sheets

(56) References Cited

U.S. PATENT DOCUMENTS

2011/0068194 A1* 3/2011 Tsukamoto ..... F02M 53/043
239/132.3

* cited by examiner

FUEL INJECTOR ASSEMBLY HAVING SLEEVE FOR DIRECTING FUEL FLOW

TECHNICAL FIELD

The present disclosure relates generally to a fuel injector assembly where fuel is used to cool a fuel pressurization mechanism, and more particularly to a flow-directing sleeve structured to direct a flow of the cooling fuel into and out of the fuel injector.

BACKGROUND

Internal combustion engines are well-known and widely used for providing power for vehicle propulsion, power generation, and still other applications where it is desirable to rotate parts in machinery. A great many different strategies for fueling internal combustion engines, ranging from different fuel types to different mechanisms for delivering fuel to engine cylinders, have been proposed over the years. Certain designs mix fuel with air in the intake conduit to an engine housing, with the fuel and air charge commonly being spark ignited within individual cylinders. Other common designs inject fuel directly into an engine cylinder. So-called direct injection fueling strategies are typically used in compression ignition diesel engines. One characteristic of compression ignition diesel engines is the need to increase pressure of the fuel to a relatively high injection pressure prior to delivery into relatively highly compressed air within an engine cylinder.

Decades ago engineers developed a fuel system known as a common rail where a fuel reservoir is maintained at or close to a desired injection pressure. A plurality of individual fuel injectors fluidly connected to the common rail can be supplied with the fuel at rail pressure and selectively operated to effect fuel injection. In more recent years, a variation on the common rail design was developed where a plurality of separate fuel accumulators are positioned fluidly between a common rail and each of a plurality of fuel injectors. The plurality of accumulators are coupled together in a so-called daisy chain arrangement, with the overall apparatus still commonly referred to as a common rail or common rail-type fuel system.

Despite advances in common rail and related fuel system technologies, engine systems are still in widespread use where unit pumps are provided as a part of or coupled with each individual fuel injector. In a typical unit pump or unit injector design each of the fuel injectors in the engine is equipped with a cam-actuated fuel pump that provides pressurized fuel for injection. Variations on the cam-actuated design include the incorporation of various control valves to at least partially decouple a timing and manner of fuel injection from the rotation of the cam. Both common rail systems and unit pump strategies can produce heat from the intense pressurization of the fuel and friction between moving components, in some instances producing some challenges to sufficient cooling of the equipment. U.S. Pat. No. 8,480,009 proposes a low-leakage large-bore fuel system having a common rail fluidly connected to different types of fuel. A plurality of fuel injectors are fluidly connected to the common rail and each includes a cooling inlet and a cooling outlet.

SUMMARY OF THE INVENTION

In one aspect, a fuel injector assembly includes a fuel pressurization mechanism, and a fuel injector coupled with the fuel pressurization mechanism. The fuel injector includes an injector body defining a nozzle outlet for injecting pressurized fuel into an engine cylinder, a fuel inlet, a fuel outlet, an incoming cooling passage extending between the fuel inlet and the fuel pressurization mechanism, and an outgoing cooling passage extending between the fuel pressurization mechanism and the fuel outlet. A flow-directing sleeve is positioned about the injector body, and defines a longitudinal axis. The sleeve includes a first sealing surface extending circumferentially around the longitudinal axis and structured to sealingly contact a cylinder head in the internal combustion engine, and a second sealing surface extending circumferentially around the longitudinal axis and structured to sealingly contact the injector body. A first slot is formed at least in part in the first sealing surface, for fluidly connecting the fuel inlet to a first segment of a fuel conduit within the cylinder head, and a second slot is formed at least in part in the second sealing surface, for fluidly connecting the fuel outlet to a second segment of the fuel conduit.

In another aspect, an engine system includes a cylinder head defining a fuel conduit having a first segment and a second segment, and an injector bore positioned fluidly between the first segment and the second segment of the fuel conduit. A fuel injector is positioned at least partially within the injector bore, and includes a fuel pressurization mechanism. The fuel injector includes an injector body defining a fuel inlet, a fuel outlet, an incoming cooling passage extending between the fuel inlet and the fuel pressurization mechanism, and an outgoing cooling passage extending between the fuel pressurization mechanism and the fuel outlet. A flow-directing sleeve is positioned about the injector body and defines a longitudinal axis, the flow-directing sleeve including a first sealing surface extending circumferentially around the longitudinal axis and in sealing contact with the cylinder head, and a second sealing surface extending circumferentially around the longitudinal axis and in sealing contact with the injector body. A first slot is formed at least in part in the first sealing surface and fluidly connects the fuel inlet to the first segment of the fuel conduit, and a second slot is formed at least in part in the second sealing surface and fluidly connects the fuel outlet to the second segment of the fuel conduit.

In still another aspect, a sleeve for directing a flow of cooling fuel into and out of a fuel injector in a cylinder head of an internal combustion engine includes a one-piece annular body positionable about a fuel injector. The one-piece body defines a longitudinal axis and includes a first axial end, a second axial end, and an inner peripheral surface and an outer peripheral surface each extending between the first axial end and the second axial end. The outer peripheral surface includes a first sealing surface structured to sealingly contact a cylinder head within an injector bore receiving the fuel injector within the cylinder head. The first sealing surface extends circumferentially around the longitudinal axis at a first location axially between the first axial end and the second axial end. The inner peripheral surface includes a second sealing surface structured to sealingly contact the fuel injector, and extending circumferentially around the longitudinal axis at a second location axially between the first axial end and the second axial end. A first slot is formed at least in part in the first sealing surface, for fluidly connecting a fuel inlet in the fuel injector to a first segment of a fuel conduit within the cylinder head. A second slot is formed at least in part in the second sealing surface for fluidly connecting a fuel outlet in the fuel injector to a second segment of the fuel conduit.

DETAILED DESCRIPTION

Figure 1:
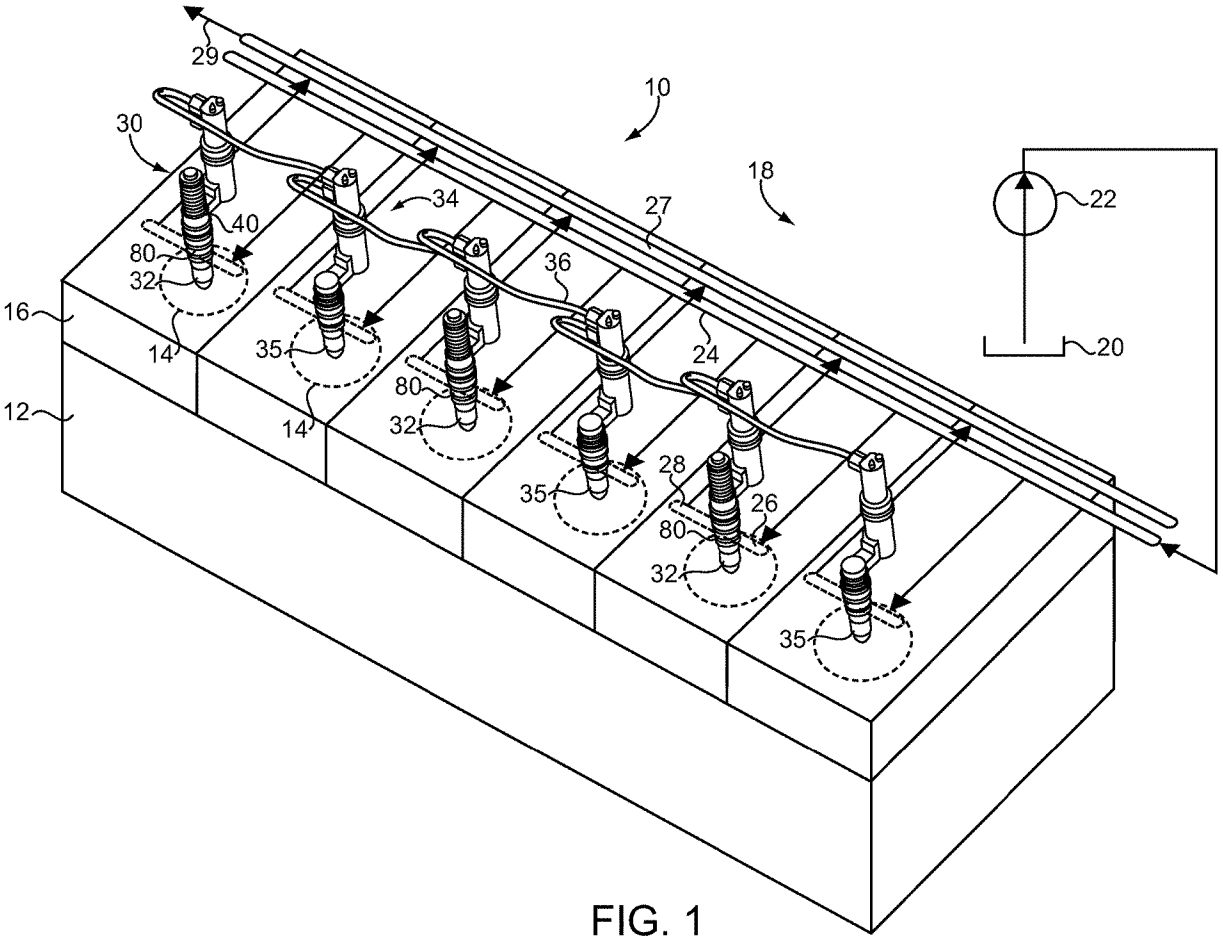
FIG. 1 is a diagrammatic view of an engine system, according to one embodiment.

Referring to FIG. 1, there is shown an engine system 10 according to one embodiment, and including a cylinder block 12 having a plurality of cylinders 14 formed therein, and a cylinder head 16 coupled to cylinder block 12. Engine system 10 may include a direct injected compression ignition diesel internal combustion engine, however, the present disclosure is not thereby limited. Cylinders 14 may be in-line, include two cylinder banks in a V-configuration, or any other suitable architecture. Engine system 10 further includes a fuel system 18 having a fuel tank 20, a fuel pump 22 structured to transfer a fuel from fuel tank 20 to a fuel conduit 24 extending through cylinder head 16 to a drain outlet 29 that may feed back to fuel tank 20, for instance. Cylinder head 16 may be arranged into a plurality of separate sections each clamped to cylinder block 12 in a generally conventional manner. Fuel conduit 24 may have a first segment 26 and a second segment 28 within each section of cylinder head 16, the significance of which will be further apparent from the following description.

Figure 2:
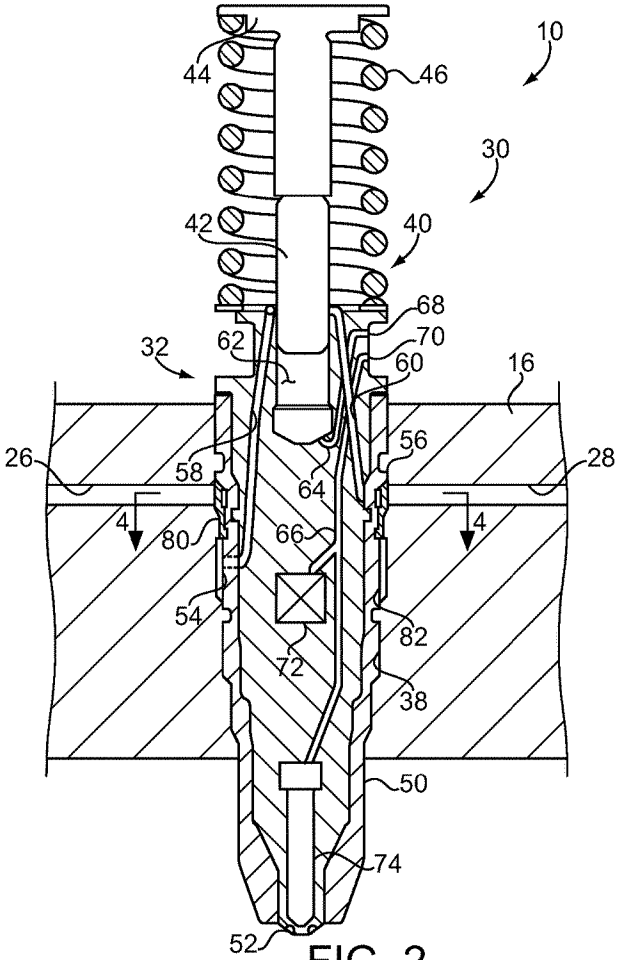
FIG. 2 is a sectioned side diagrammatic view through a portion of the engine system of FIG. 1.
Figure 4:
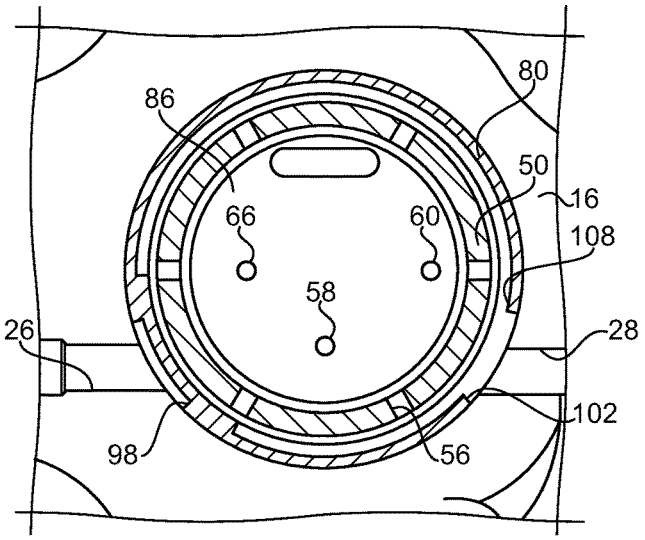
FIG. 4 is a sectioned view taken along line 4-4 of FIG. 2.

In the illustrated embodiment, fuel system 18 further includes a plurality of fuel injector assemblies 30 each including a fuel injector 32, with the plurality of fuel injectors 32 being understood as a first set of fuel injectors. Fuel system 18 further includes a plurality of fuel injector assemblies 34 each including a fuel injector 35, with fuel injectors 35 being understood as a second set of fuel injectors. Fuel injector assemblies 30 may be different from fuel injector assemblies 34. Referring also to FIG. 2, each of the first set of fuel injectors 32 may include a fuel pressurization mechanism 40 having a plunger 42 and a tappet 44 and a return spring 46, such that plunger 42 is reciprocated in response to movement of tappet 44 caused by way of the rotation of an engine cam (not shown). Each of the second set of fuel injectors 35 does not include a fuel pressurization mechanism in the illustrated embodiment. It can also be noted that a number of fuel injectors 32 equipped with fuel pressurization mechanisms 40 is equal to a number of fuel injectors 35 that are not equipped with a fuel pressurization mechanism, and fuel injectors 32 and 35 are in an alternating arrangement in the illustrated embodiment. It should be appreciated that while a 1:1 ratio of fuel injectors with a fuel pressurization mechanism to fuel injectors without a fuel pressurization mechanism provides one practical implementation strategy, alternatives are contemplated. In other instances the number of fuel injectors equipped with a fuel pressurization mechanism may be greater than the number of fuel injectors not equipped with a fuel pressurization mechanism, or vice versa. Those skilled in the art will appreciate various factors such as desired injection pressures, efficiency, and engine dynamics that might cause a particular combination or geometric arrangement of pressurization mechanism-equipped versus not pressurization mechanism-equipped injectors to be used.

A common fuel rail 36 is provided that fluidly couples all of fuel injector assemblies 30 and fuel injector assemblies 34. Alternative designs are contemplated where a first common rail is used for a first group of fuel injector assemblies 30 and fuel injector assemblies 34, and a second common rail is used for another group. Common rail 36 provides a common fluid connection the pressure of which is controlled by the pumping action of pumping mechanisms 40, and from which pressurized fuel can be supplied to any of fuel injectors 32 and fuel injectors 35. Additional fluid accumulation volume may be provided within fuel injector assemblies 30 and 34. In the illustrated embodiment common rail 36 includes a plurality of separate fluid conduits that connect the respective fuel injector assemblies, however, those skilled in the fuel system arts will contemplate still other alternatives.

It will be recalled that fuel conduit 24 may include a plurality of segments, within each of the different sections of cylinder head 16. To this end, in FIG. 2 first segment 26 is shown extending through cylinder head 16, and second segment 28 is shown extending through cylinder head 16, with an injector bore 38 positioned fluidly between first segment 26 and second segment 28 and receiving a fuel injector 32 at least partially therein. Fuel injector 32 can be seen to be coupled with fuel pressurization mechanism 40, and in the illustrated embodiment directly attached to fuel pressurization mechanism 40. Fuel injector 32 includes an injector body 50 defining a nozzle outlet 52, typically a plurality of nozzle outlets, for injecting pressurized fuel into an engine cylinder. Injector body 50 further defines a fuel inlet 54, and a fuel outlet 56. In a practical implementation strategy, a plurality of fuel inlets may be formed in injector body 50, in a generally known manner. Analogously, a plurality of fuel outlets 56 may be formed in injector body 50. As will be further apparent from the following description, fuel injector assembly 30 may be uniquely configured to direct fuel for cooling internal components of fuel injector 32, and more particularly for cooling fuel pressurization mechanism 40. It can be noted that first segment 26 of fuel conduit 24 and second segment 28 of fuel conduit 24 define a common plane. It has been discovered that attempting to direct fuel through fuel injector 32 for cooling purposes can be challenging at least where an incoming fuel passage such as first segment 26 and an outgoing cooling passage such as second segment 28 are substantially in the same plane within a cylinder head. As suggested above, fuel injector assembly 30 includes apparatus for assisting and directing fuel to go where desired for cooling purposes.

Injector body 50 further defines an incoming cooling passage 58 extending between fuel inlet 54 and fuel pressurization mechanism 40, and an outgoing cooling passage 60 extending between fuel pressurization mechanism 40 and fuel outlet 56. In the illustration of FIG. 2 the internal plumbing of fuel injector 32 is shown diagrammatically, and certain physical structures are omitted for purposes of clarity of illustration. Thus, certain of the features shown as being in the same plane in FIG. 2 might in fact be in different planes, and typically will be. Also shown in FIG. 2 is a pumping chamber 62 within which plunger 42 reciprocates to pressurize fuel. It has been observed that leakage of highly pressurized fuel past a clearance between injector body 50 and plunger 42, or other clearances, can cause fuel heated by the pressurization to migrate into contact with parts of injector assembly 30 whose temperature is desired to be limited. It can therefore be appreciated that fuel leaking from pumping chamber 62 past plunger 42 can heat surrounding components, which heat can be rejected by pumping relatively cool fuel, or potentially another cooling fluid, through injector body 50. It will also be appreciated that fuel supplied by way of fuel conduit 24 can also travel between and among components of injector body 50, or through fuel passages dedicated as such, to fill pumping chamber 62. In the illustrated embodiment, fuel pressurized by way of downward travel of plunger 42 can be urged out of pumping chamber 62 and through a high-pressure outlet passage 64 to a high-pressure outlet 68 that connects with common rail 36. A high-pressure inlet 70 may be connected with common rail 36 and receives pressurized fuel into a high-pressure inlet passage 68. High-pressure inlet passage 68 may extend from high-pressure inlet 70 to nozzle outlet 52. An injection control valve 72 that is operated at least in part by way of hydraulic pressure, is positioned within injector body 50 and may receive pressurized fuel from high-pressure inlet passage 66. An outlet check 74 may be controlled at least in part by way of hydraulic pressure, which in turn can be varied by way of the operation of injection control valve 72, to control a timing, duration, and potentially other properties of fuel injection.

It should be appreciated that the plumbing architecture depicted in FIG. 2 is but one example, and alternatives might include a direct connection between pumping chamber 62 and high-pressure inlet passage 66. For that matter, within the context of the present disclosure fuel injectors might not be fluidly connected with one another at all, and instead of a number of fuel injectors equipped with fuel pressurization mechanisms and a number that are not equipped with fuel pressurization mechanisms, every fuel injector in an engine system might be configured to pressurize its own fuel for injection.

Figure 3:
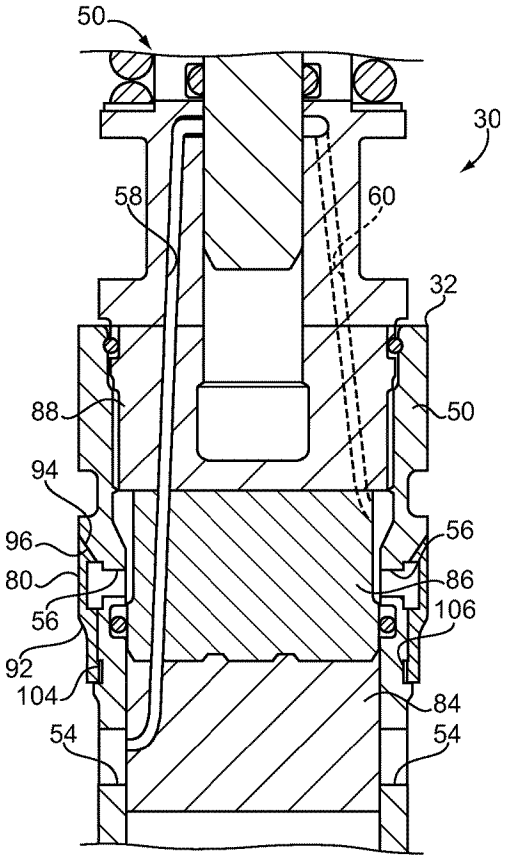
FIG. 3 is a partial sectioned side diagrammatic view of a fuel injector assembly, according to one embodiment.

Referring also now to FIG. 3, there are shown features of fuel injector 32 in additional detail, and in a different section plane, including an inner body component 84, another inner body component 86, and another body component 88. Components 84, 86 and 88 may together form a so-called stack that is received within injector body 50, and clamped together during fuel injector assembly. Also shown in FIG. 3 is a flow-directing sleeve 80 positioned about injector body 50. Referring also now to FIGS. 4-7, flow-directing sleeve 80 (hereinafter "sleeve 80") may include a one-piece annular body 90 that is positionable about fuel injector 32, namely, injector body 50, and defines a longitudinal axis 100. One-piece annular body 90 includes a first axial end 91, a second axial end 93, and an inner peripheral surface 95 and an outer peripheral surface 97 each extending between first axial end 91 and second axial end 93. Outer peripheral surface 97 includes a first sealing surface 92 extending circumferentially around longitudinal axis 100 and structured to sealingly contact cylinder head 16 within injector bore 38. First sealing surface 92 may be located at a first location axially between first axial end 91 and second axial end 93. Inner peripheral surface 95 includes a second sealing surface 94 extending circumferentially around longitudinal axis 100 and structured to sealingly contact injector body 50. Second sealing surface 94 may be located at a second location axially between first axial end 91 and second axial end 93. It can further be noted, such as at FIGS. 2 and 3, that first sealing surface 92 is closer to nozzle outlet 52, and second sealing surface 94 is further from nozzle outlet 52. Incoming cooling passage 58 and outgoing cooling passage 60 each have an axial extent and also a radial extent within injector body 50. At least a portion of sleeve 80 is located axially between fuel inlet 54 and fuel outlet 56. It can further be seen that first sealing surface 92 is an outer sealing surface of sleeve 80 and has a conical shape, and is oriented generally toward axial end 93. Second sealing surface 94 is an inner sealing surface and also has a conical shape, and is oriented generally toward axial end 91.

With reference to FIG. 2, it can further be noted that fuel outlet 56 is located at a first axial position, and a second fuel outlet comprised by high-pressure fuel outlet 68 is at a second axial position, in injector body 50 that is further from nozzle outlet 52 than the first axial position occupied by outlet 56. As shown in FIG. 3 via reference numeral 96, injector body 50 includes an outer body surface that has a conical shape, and second sealing surface 94 sealingly contacts outer body surface 96. In a practical implementation strategy, sleeve 80 may be formed from a resilient non-metallic material, such as a polymeric material having a relatively high hardness, such as a Shore D hardness of about 60. Injector body 50 is formed of metallic materials in the usual course. Sleeve 80 may be elastically deformed slightly to be slid over injector body 50, and in the illustrated embodiment until a lip 105 snaps into engagement with complementary shaped features of injector body 50. In particular, outer body surface 96 may include a first retention surface 104 facing a first axial direction, and sleeve 80 may include a second retention surface 106 such as a surface on lip 105 that faces a second axial direction opposite the first axial direction and abuts first retention surface 104 to limit axial displacement of sleeve 80 relative to injector body 50.

Sleeve 80 further includes an interior channel 108 located axially between first sealing surface 92 and second sealing surface 94, interior channel 108 extending circumferentially around longitudinal axis 100. It can be seen from the section view shown in FIG. 4 that a circumferential extent of interior channel 108 is less than 360 degrees. In a practical implementation strategy, each of fuel injector assemblies 30 may be equipped with a substantially identical sleeve 80. Fuel injector assemblies 34 may not include a flow-directing sleeve at all, and since fuel injectors 35 receive pressurized fuel from common rail 36 and are not subject to cooling requirements as with fuel injectors 32, there may be no cooling fuel flow at all to or through fuel injector assemblies 34 apart from the fuel that is supplied for injection. Thus, each sleeve 80 may be one of a plurality of flow-directing sleeves in engine system 10, and a total number of sleeves 80 in engine system 10 may be less than a total number of fuel injectors 32 and fuel injectors 35 together. The common plane defined by first segment 26 and second segment 28 of fuel conduit 24 may be oriented normal to longitudinal axis 100.

As noted above, sleeve 80 is structured to direct flow to where such flow is desired for cooling purposes in fuel injector 32, and to receive fuel from fuel injector 32 after having exchanged heat, for example, with fuel pressurization mechanism 40. To this end, a first slot 98 is formed at least in part in first sealing surface 92, for fluidly connecting fuel inlet 54 to first segment 26 of fuel conduit 24 within cylinder head 16. A second slot 102 is formed at least in part in second sealing surface 94, for fluidly connecting fuel outlet 56 to second segment 28 of fuel conduit 24. It has been discovered that causing fuel to flow upward through injector body 50 to cool fuel pressurization mechanism 40 may be challenging without some accommodation to direct and concentrate the incoming fuel flow, as otherwise insufficient pressure may be available to vertically raise the fuel flow to the fuel pressurization mechanism mounted upon the injector body. It can be noted that first slot 98 may be located at a first circumferential location about longitudinal axis 100, and second slot 102 located at a second circumferential location about longitudinal axis 100 that is less than 180 degrees from the first circumferential location. This pattern and arrangement of the location of slots 98 and 102 can accommodate existing fuel conduit placement within cylinder head 16, the significance of which will be further apparent from the following description.

Figure 5:
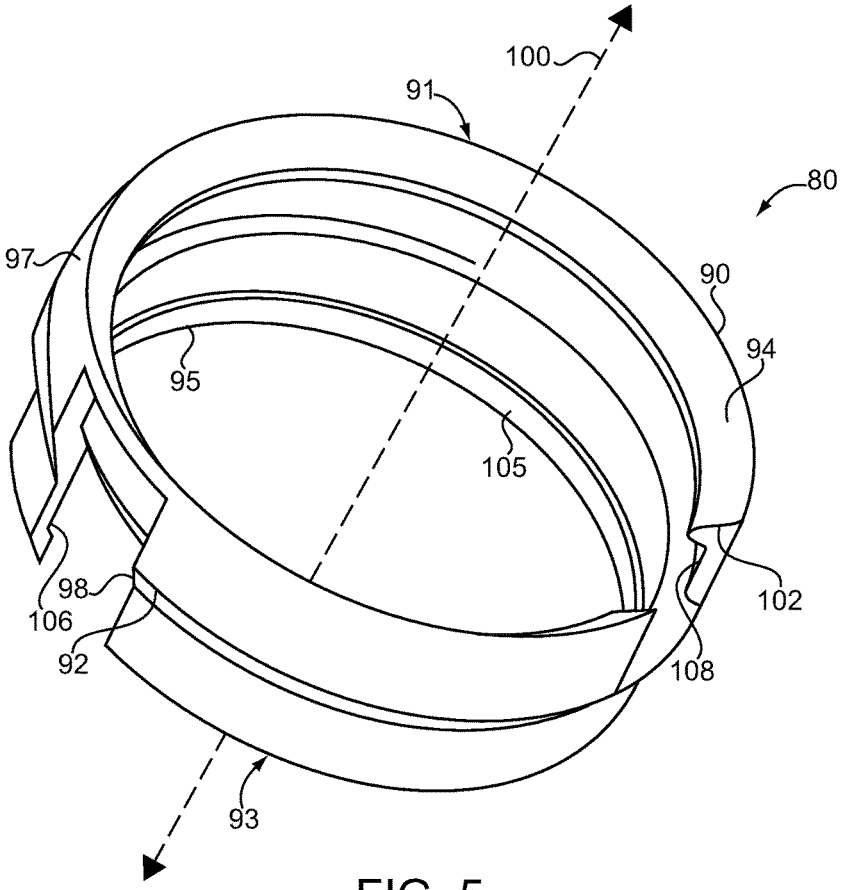
FIG. 5 is a diagrammatic view of a flow-directing sleeve for a fuel injector assembly, according to one embodiment.
Figure 6:
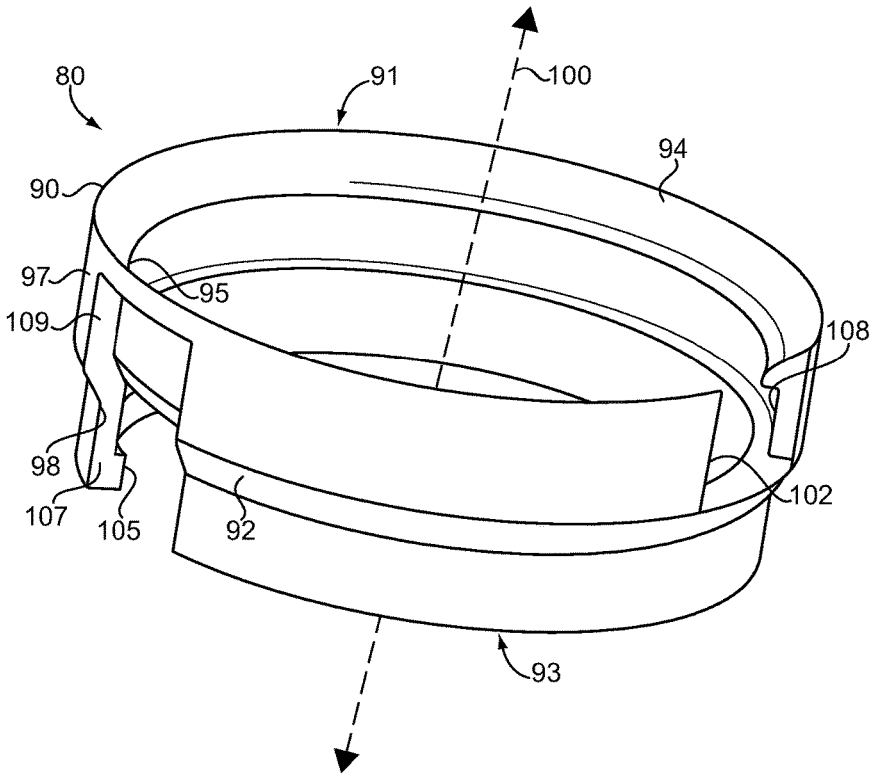
FIG. 6 is another diagrammatic view of the flow-directing sleeve of FIG. 5.
Figure 7:
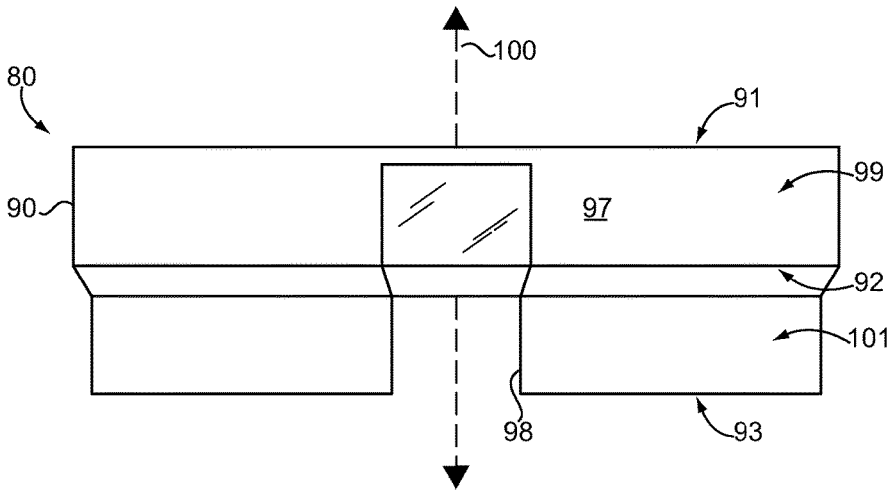
FIG. 7 is yet another diagrammatic view of the flow-directing sleeve of FIGS. 5 and 6.

It can also be seen, for example, from FIGS. 5, 6 and 7, that each of slots 98 and 102 communicates between outer peripheral surface 97 and inner peripheral surface 95. Each slot 98 and 102 may have an axial extent greater than just the corresponding first sealing surface 92 and second sealing surface 94. As shown in FIG. 7, outer peripheral surface 97 has a first axial surface segment 99 that adjoins first axial end 91, and a second axial segment 101 that adjoins second axial end 93. First sealing surface 92 extends axially between first axial segment 99 and second axial segment 101. Second sealing surface 94 adjoins first axial end 91. Sleeve 80 may further be understood as formed of a downwardly extending first wall 98 having a first outer diameter dimension, and an upwardly extending second wall 109 that has a second outer diameter dimension that is slightly larger than the first outer diameter dimension. In a practical implementation strategy, the differing size of wall section 107 and wall section 109 enables a cavity 82 to extend between injector body 50 and cylinder head 16, as shown in FIG. 2.

INDUSTRIAL APPLICABILITY

Referring to the drawings generally, during operation of engine system 10 cooling fuel traveling through first segment 26 may flow initially into a portion of slot 98 formed in wall section 109, and then be directed downwardly toward second axial end 93, but permitted to flow circumferentially around wall 107 within cavity 82, with upward migration of fuel from cavity 82 limited by way of the seal formed between first sealing surface 92 and cylinder head 16. From cavity 82 the fuel may flow upwardly through incoming cooling passage 58 to fuel pressurization mechanism 40, to exchange heat therewith. Highly pressurized, hot fuel that has migrated past a clearance around plunger 42 can mix with the cooling fuel and be carried away via flow through outgoing cooling passage 60. From passage 60, the cooling fuel may travel downwardly and exit through the one or more fuel outlets 56 into channel 108. Channel 108 can guide the flow of fuel towards slot 102, with migration of the fuel out of channel 108 being limited by way of the sealing contact between second sealing surface 94 and injector body 50, and contact between wall 107 of sleeve 80 and injector body 50, such that the fuel is conveyed via slot 102 into second segment 28.

Those skilled in the art will be familiar with the desirability of equipping used but still serviceable equipment with substitute or add-on components that enable new and/or improved functionality. According to the present disclosure, fuel system 18 may be swapped into an existing engine system in place of an old fuel system that is in need of replacement or upgrade. It will be recalled that fuel conduit 24 is generally within a single plane through cylinder head 16. In certain earlier engine systems, a fuel conduit generally analogous to fuel conduit 24 was used to convey fuel to a fuel injector for pressurization and injection, with each fuel injector being operable independently of the others and not fluidly connected to other fuel injectors. While not limited as such, the present disclosure is contemplated to enable a common rail fuel system to be swapped in for an existing unit pump fuel system, with sleeve 80 adapting the existing fuel plumbing architecture in the cylinder head to be suitable for cooling of fuel pressurization mechanisms in the fuel injector assemblies.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims.

What is claimed is:

1. A fuel injector assembly comprising:

a fuel pressurization mechanism;

a fuel injector coupled with the fuel pressurization mechanism, and including an injector body defining a nozzle outlet for injecting pressurized fuel into an engine cylinder, a fuel inlet, a fuel outlet, an incoming cooling passage extending between the fuel inlet and the fuel pressurization mechanism, and an outgoing cooling passage extending between the fuel pressurization mechanism and the fuel outlet;

a flow-directing sleeve positioned about the injector body, the flow-directing sleeve defining a longitudinal axis and including a first sealing surface extending circumferentially around the longitudinal axis and structured to sealingly contact a cylinder head in the internal combustion engine, and a second sealing surface extending circumferentially around the longitudinal axis and structured to sealingly contact the injector body; and a first slot being formed at least in part in the first sealing surface, for fluidly connecting the fuel inlet to a first segment of a fuel conduit within the cylinder head, and a second slot being formed at least in part in the second sealing surface, for fluidly connecting the fuel outlet to a second segment of the fuel conduit.

2. The assembly of claim 1 wherein at least a portion of the flow-directing sleeve is located axially between the fuel inlet and the fuel outlet, and wherein the first sealing surface includes an outer sealing surface having a conical shape, and the second sealing surface includes an inner sealing surface having a conical shape.

3. The assembly of claim 2 wherein the first sealing surface is positioned at a first axial location closer to the nozzle outlet, and the second sealing surface is positioned at a second axial location further from the nozzle outlet, and wherein the incoming cooling passage and the outgoing cooling passage each have an axial extent and a radial extent within the injector body.

4. The assembly of claim 3 wherein the injector body includes an outer body surface including a first retention surface facing a first axial direction, and the flow-directing sleeve includes a second retention surface facing a second axial direction that is opposite the first axial direction and abutting the first retention surface to limit axial displacement of the flow-directing sleeve relative to the injector body.

5. The assembly of claim 4 wherein the outer body surface includes an outer injector body surface having a conical shape, and the second sealing surface sealingly contacts the outer body surface.

6. The assembly of claim 3 wherein the first slot is positioned at a first circumferential location about the longitudinal axis, and the second slot is positioned at a second circumferential location about the longitudinal axis that is less than 180 degrees from the first circumferential location.

7. The assembly of claim 5 wherein the flow-directing sleeve includes an interior channel located axially between the first sealing surface and the second sealing surface, the interior channel extending circumferentially around the longitudinal axis and fluidly connecting the fuel outlet to the second slot.

8. The assembly of claim 1 wherein the fuel pressurization mechanism is attached to the injector body and includes a plunger, and a tappet coupled with the plunger.

9. The assembly of claim 8 wherein the fuel outlet is located at a first axial position in the injector body, and the injector body defines a second fuel outlet located at a second axial position in the injector body that is further from the nozzle outlet than the first axial position.

10. An engine system comprising:

a cylinder head defining a fuel conduit having a first segment and a second segment, and an injector bore positioned fluidly between the first segment and the second segment of the fuel conduit;

a fuel injector positioned at least partially within the injector bore, and including a fuel pressurization mechanism;

the fuel injector including an injector body defining a fuel inlet, a fuel outlet, an incoming cooling passage extending between the fuel inlet and the fuel pressurization mechanism, and an outgoing cooling passage extending between the fuel pressurization mechanism and the fuel outlet;

a flow-directing sleeve positioned about the injector body and defining a longitudinal axis, the flow-directing sleeve including a first sealing surface extending circumferentially around the longitudinal axis and in sealing contact with the cylinder head, and a second sealing surface extending circumferentially around the longitudinal axis and in sealing contact with the injector body; and a first slot being formed at least in part in the first sealing surface and fluidly connecting the fuel inlet to the first segment of the fuel conduit, and a second slot being formed at least in part in the second sealing surface and fluidly connecting the fuel outlet to the second segment of the fuel conduit.

11. The system of claim 10 wherein the first segment of the fuel conduit and the second segment of the fuel conduit define a common plane oriented normal to the longitudinal axis.

12. The system of claim 10 wherein the fuel injector is one of a first set of fuel injectors each including a fuel pressurization mechanism having a plunger and a tappet coupled with the plunger, and further comprising a second set of fuel injectors each of which does not include a fuel pressurization mechanism.

13. The system of claim 12 wherein the flow-directing sleeve is one of a plurality of flow-directing sleeves in the engine system, and a total number of the plurality of flow-directing sleeves is equal to less than a total number of the fuel injectors of the first set.

14. The system of claim 12 further comprising a common fuel rail, and wherein each of the fuel injectors of the first set and each of the fuel injectors of the second set is in fluid communication with the common fuel rail.

15. A sleeve for directing a flow of cooling fuel into and out of a fuel injector in a cylinder head of an internal combustion engine, the sleeve comprising:

a one-piece annular body positionable about a fuel injector, the one-piece annular body defining a longitudinal axis and including a first axial end, a second axial end, and an inner peripheral surface and an outer peripheral surface each extending between the first axial end and the second axial end;

the outer peripheral surface including a first sealing surface structured to sealingly contact a cylinder head within an injector bore receiving the fuel injector within the cylinder head, the first sealing surface extending circumferentially around the longitudinal axis at a first location axially between the first axial end and the second axial end;

the inner peripheral surface including a second sealing surface structured to sealingly contact the fuel injector, and extending circumferentially around the longitudinal axis at a second location axially between the first axial end and the second axial end;

a first slot being formed at least in part in the first sealing surface, for fluidly connecting a fuel inlet in the fuel injector to a first segment of a fuel conduit within the cylinder head; and a second slot being formed at least in part in the second sealing surface, for fluidly connecting a fuel outlet in the fuel injector to a second segment of the fuel conduit.

16. The sleeve of claim 15 wherein the first slot is positioned at a first circumferential location about the longitudinal axis, and the second slot is positioned at a second circumferential location about the longitudinal axis that is less than 180 degrees from the first circumferential location.

17. The sleeve of claim 15 wherein the first sealing surface has a conical shape and is oriented toward the second axial end, and wherein the second sealing surface has a conical shape and is oriented toward the first axial end.

18. The sleeve of claim 17 wherein the first slot and the second slot each communicate between the outer peripheral surface and the inner peripheral surface, and the first slot and the second slot open to the second axial end and the first axial end, respectively.

19. The sleeve of claim 16 wherein the outer peripheral surface includes a first axial segment adjoining the first axial end, a second axial segment adjoining the second axial end, and the first sealing surface extends axially between the first axial segment and the second axial segment, and wherein the second sealing surface adjoins the first axial end.

20. The sleeve of claim 15 further comprising a channel formed by the inner peripheral surface and extending circumferentially around the longitudinal axis at a location that is axially between the first axial end and the second axial end, and the channel being in communication with the second slot.

* * * * *